United States Patent [19]

Woodle

[11] 4,079,770

[45] Mar. 21, 1978

[54] VALENCE CONSTRUCTION FOR VERTICAL VENETIAN BLINDS

[76] Inventor: Allan S. Woodle, 420 Mt. Pleasant Ave., Mamaroneck, N.Y. 10543

[21] Appl. No.: 781,711

[22] Filed: Apr. 11, 1977

[51] Int. Cl.[2] ..... E06B 9/00

[52] U.S. Cl. ..... 160/19; 160/39; 160/168 R

[58] Field of Search ..... 160/19, 38, 39, 345, 160/346, 168, 172; 16/94 R, 94 D

[56] References Cited

U.S. PATENT DOCUMENTS

| | | | |
|---|---|---|---|
| 2,966,696 | 1/1961 | Young | 16/94 D |
| 3,346,909 | 10/1967 | Blackburn | 16/94 D |
| 3,435,876 | 4/1969 | Toti | 160/38 |
| 3,463,217 | 8/1969 | Assael | 160/39 |

*Primary Examiner*—Peter M. Caun

*Attorney, Agent, or Firm*—Charles E. Temko

[57] ABSTRACT

An improved valance construction for use with a horizontally disposed track element supporting a vertical louver venetian blind. The same material used for the fabrication of the fabric louvers may be bonded to a rigid planar backing, the backing in turn being supported by a plurality of clips secured to the track element at convenient intervals.

1 Claim, 4 Drawing Figures

FIG. 1
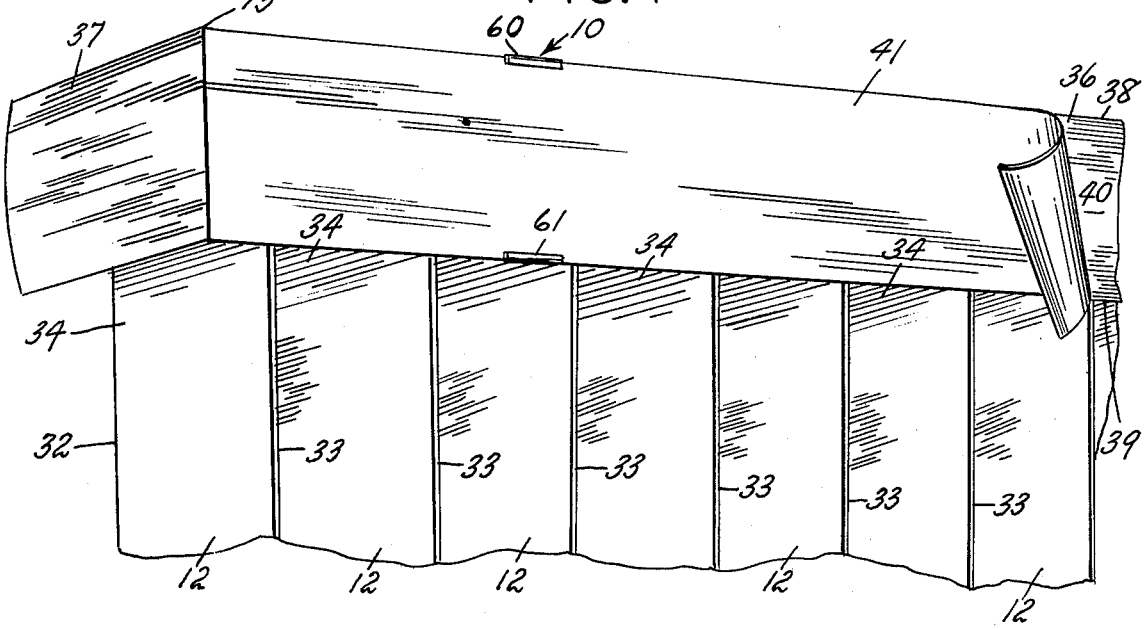
FIG. 2
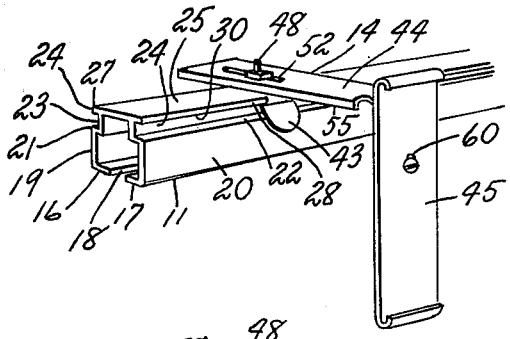
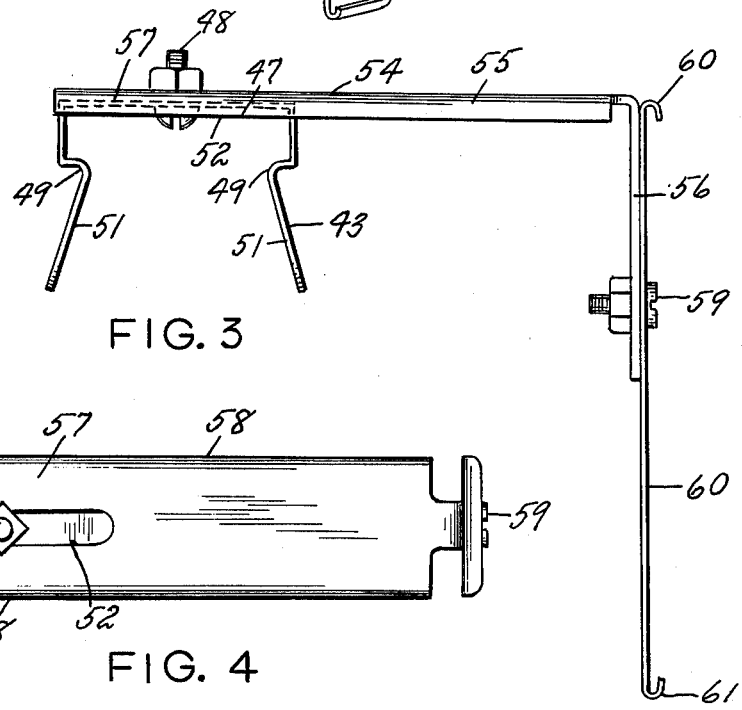
FIG. 3
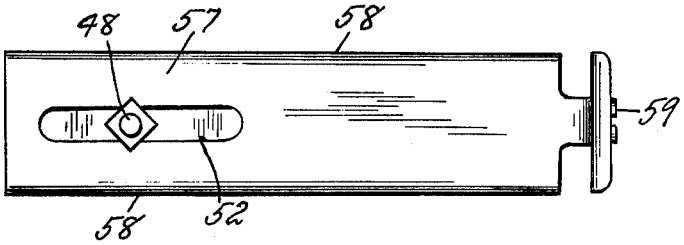
FIG. 4

VALENCE CONSTRUCTION FOR VERTICAL VENETIAN BLINDS

BACKGROUND OF THE INVENTION

In the drapery art, it is known to provide a valance of generally U-shaped configuration, including a main portion, the axis of which is parallel to the plane of the opening covering the drapery, as well as so-called return portions, the ends of which are secured in one manner or another to the edges of the opening or surrounding wall surfaces. Such valance structure is completely independent of the drape in a mechanical sense, and consequently the mounting of the same involves considerable duplication of hardware.

This practice has been followed to some degree in the installation of horizontally oriented venetian blinds, where the tilting and raising mechanisms must be adequately concealed to present an acceptable appearance. In typical installations of this type, it is common to secure the free edges of the returns of the valance to a frame which supports the slats.

Vertical louver type blinds normally include a horizontally oriented track element supported at the ends thereof, in which the upper ends of the individual louvers are in turn supported for axial rotation and planar movement, the louvers being interconnected by cords for this purpose. The horizontal track element which supports the louvers is normally not attractive, and has been concealed from view in the classic manner.

SUMMARY OF THE INVENTION

Briefly stated, the invention contemplates the provision of an improved vertical louver blind construction incorporating the usual horizontally oriented upper track member and a novel valance construction of substantially rigid planar material supported by brackets at medially disposed intervals, which brackets clip directly to the valance and to an upper portion of the track element, so as to be simply installed and removed, and adequately supported at points other than the return portions thereof. By adjustably relating the location of the supporting brackets to the return, adequate coverage of unattractive parts is assured, and the tendency of the valance returns to droop, if not supported at these points of termination is avoided.

BRIEF DESCRIPTION OF THE DRAWING

In the drawing, to which reference will be made in the specification, similar reference characters have been employed to designate corresponding parts throughout the several views.

FIG. 1 is a fragmentary view in perspective of an embodiment of the invention.

FIG. 2 is a fragmentary view in perspective of a horizontally supported track element and a valance supporting bracket forming parts of the embodiment.

FIG. 3 is a side elevational view of a valance supporting bracket in detached condition.

FIG. 4 is a top plan view thereof as seen from the plane 4—4 in FIG. 2.

DETAILED DESCRIPTION OF THE DISCLOSED EMBODIMENT

In accordance with the invention, the device, generally indicated by reference character 10, comprises broadly: a horizontally supported track element 11, a plurality of vertical louvers 12, a valance element 13, and a plurality of valance element supporting brackets 14.

The track element 11 is preferably formed as a metallic extrusion, in a manner known in the art, and includes first and second lower walls 16 and 17, respectively, defining an elongated slot 18 which slidably engages individual louver supporting elements (not shown). The lower walls 16 and 17 communicate with respective side walls 19 and 20, in turn communicating with intermediate horizontal walls 21 and 22, intermediate vertical walls 23 and 24, and an upper horizontal wall 25 bounded by an upper surface 26 and first and second longitudinal edges 27 and 28. The walls 21–25 form first and second elongated recesses 29 and 30.

The vertical louvers 12 are conventional, the details of which form no part of the present disclosure. Each is bounded by inner and outer longitudinal edges 32 and 33, respectively, as well as upper ends 34 supported from the track element 11 as described hereinabove.

The valance element 13 is preferably formed as a single strip of bendable material, such as aluminum or steel, and includes a transverse member 36, and a pair of return members, one of which is indicated by reference character 37. The element 13 is bounded by a continuous upper edge 38 and a continuous lower edge 39. An outer surface 40 may be completely covered by a layer of fabric 41 bonded thereto, which fabric matches that employed in the formation of the vertical louvers 12.

The valance element supporting brackets 14 are substantially similar, and, accordingly, a description of one of such elements will serve to describe all. Each element includes a track engaging member 43, a laterally extending member 44 and a valance supporting member 45. Most conveniently each of the members 43–45, inclusive, may be formed as an injection molding or a metallic stamping.

The track engaging member 43 includes a base portion 47 secured by a screw 48 to the laterally extending member 44. A pair of curved engaging members 49 define a recess 50 in which the longitudinal edges 27 and 28 of the wall 25 are selectively positioned to be resiliently retained thereby. The members 49 communicate with angularly disposed cam members 51 which facilitates engagement during installation of the valance.

The laterally extending member 44 includes a horizontal portion 54, as well as one or more bent edge portions 55 to enhance rigidity. A vertical portion 56 communicating therewith extends downward therefrom.

The vertical portion 56 is penetrated by a screw 59 which provides engagement with the member 45.

The valance supporting member 45 may be formed as a stamping from sheet metal, or from synthetic resinous materials. It includes a main wall 60 and upper and lower curved portions 60 and 61, respectively, capable of engaging the upper and lower edges 38 and 39 of the transverse member 36. The main wall includes a slotted opening 60, generally centrally located, which allows for adjusting the height of the valance relative to the track element 11, so that the upper ends of the louvers 12 may be adequately concealed. This adjustment, coupled with the adjustment of the screw 48 in the slot 52 allows provision for both horizontal and vertical adjustment of the balance element 13 at each individual point of support therealong.

I wish it to be understood that I do not consider the invention limited to the precise details of structure shown and set forth in this specification, for obvious modifications will occur to those skilled in the art to which the invention pertains.

I claim:

1. In an improved valance construction for vertical venetian blinds and the like, including a horizontally disposed track element having a pair of parallel oppositely disposed recesses therein, a plurality of vertically oriented louvers supported at the upper ends thereof from said track element, and an elongated generally planar valance element overlying an exposed side of said track element, the improvement comprising: a plurality of valance element supporting brackets, each bracket having a track element engaging member including means engaging said longitudinal recesses therein, a horizontally disposed laterally extending member having a laterally oriented slot therein slidably adjustably mounted by said track engaging member, and a vertically disposed valance engaging member having a vertically oriented slot therein; first screw means penetrating said first mentioned slot and said track element engaging member, and second screw means penetrating said second mentioned slot and said valance engaging member; whereby said valance engaging member may be separately longitudinally, laterally and vertically adjusted relative to said track element.

* * * * *